United States Patent [19]

Riva

[11] Patent Number: 4,653,701

[45] Date of Patent: Mar. 31, 1987

[54] DELIVERY DEVICE FOR CONTINUOUS THREADS

[75] Inventor: Ermete Riva, Pagnana di Merate, Italy

[73] Assignee: Sobrevin Sociètè de Brevets Industriels-Etablissement, Vaduz, Liechtenstein

[21] Appl. No.: 832,494

[22] Filed: Feb. 21, 1986

[30] Foreign Application Priority Data

Feb. 23, 1985 [DE] Fed. Rep. of Germany ..... 3506489

[51] Int. Cl.[4] ..... B65H 51/20

[52] U.S. Cl. ..... 242/47.01; 242/47.12

[58] Field of Search ..... 242/47.01, 47.02, 47.03, 242/47.04, 47.05, 47.06, 47.07, 47.08, 47.09, 47.1, 47.11, 47.12, 47.13, 36, 37 R, 39, 47, 49; 139/452; 66/132 R, 132 T; 250/200, 227, 548, 571, 559–563

[56] References Cited

U.S. PATENT DOCUMENTS

| | | | |
|---|---|---|---|
| 3,411,548 | 11/1968 | Pfarrwaller | 242/47.01 X |
| 3,490,710 | 1/1970 | Muhlhausler | 242/47.01 |
| 3,843,069 | 10/1974 | Deniega et al. | 242/47.01 X |
| 4,010,908 | 3/1977 | Patterson | 242/36 |
| 4,165,049 | 8/1979 | Pejchal et al. | 242/47.01 |
| 4,180,215 | 12/1979 | Nurk | 242/47.01 |
| 4,325,520 | 4/1982 | Hintsch | 242/47.01 |
| 4,452,402 | 6/1984 | Ghiardo | 242/47.01 |

FOREIGN PATENT DOCUMENTS

| | | |
|---|---|---|
| 1262847 | 3/1968 | Fed. Rep. of Germany . |
| 485586 | 5/1970 | Switzerland . |

*Primary Examiner*—Stanley N. Gilreath
*Attorney, Agent, or Firm*—Martin A. Farber

[57] ABSTRACT

A delivery device for continuous threads, having a storage member (5) to which the thread passes in circumferential direction and from which the thread is withdrawn over head, on which member a given adjustable number of thread turns is stored as storage quantity between point of feed and point of withdrawal, a light monitor which scans the outer surface of the storage member and controls the rotary drive for delivering the thread being provided in order to determine the turns of thread. In order to achieve a high output construction which is insensitive to disturbance, the storage member (5) has a light guide, the end surfaces (35', 35") of which are exposed towards the outer surface (6) of the storage member, one end surface (35') of each light guide facing the transmitter (29) of the light monitor and the other end surface (35"), staggered in circumferential direction of the storage member (5), facing the receiver (30) of the light monitor.

6 Claims, 6 Drawing Figures

DELIVERY DEVICE FOR CONTINUOUS THREADS

FIELD AND BACKGROUND OF THE INVENTION

The present invention relates to a delivery device for continuous threads, having a storage member to which the thread passes in circumferential direction and from which it is withdrawn over head, on which member a given adjustable number of thread turns is accumulated as a storage quantity between feed point and withdrawal end, a light monitor which controls the rotary drive for the delivery of the thread and scans the outer surface of the storage member being provided in order to determine the number of thread turns.

Such devices are available on the market. The light monitor is formed of a transmitter and a receiver in such a manner that the light emitted by the transmitter strikes against a mirror of the storage member, is reflected by said mirror and sent to the receiver. Instead of an installed mirror or reflector plate the outer surface can itself be made reflective. This device has the disadvantage that the light monitor can be affected by disturbing effects from daylight or the like, which then leads to incorrect switchings of the rotary drive.

The object of the present invention is to provide a delivery device having a light monitor which responds essentially only to the light sent out by the transmitter.

SUMMARY OF THE INVENTION

According to the invention there is provided a delivery device for continuous threads, having a storage member to which a thread passes in circumferential direction and from which the thread is withdrawn over head, on which member a predetermined adjustable number of turns of thread is stored as a storage quantity between a place of feed of the thread and a place of withdrawal of the thread, a light monitor which scans the outer surface of the storage member for determining the turns of thread and controls the rotary drive for delivering of the thread, the improvement wherein the light monitor comprises a transmitter and a cooperating receiver, the storage member has a light guide having end surfaces exposed towards an outer surface of the storage member, one of said end surfaces of each light guide faces the transmitter and the other of said end surfaces faces the receiver, said other end surface is staggered in circumferential direction of the storage member relative to said one end surface.

As a result of this development there is created a delivery device of this type which is of high output and insensitive to disturbance. The reflection principle is replaced by the light-guide principle from a place on the circumference to an adjacent place. The cross-sectional area of the light guide can be considerably less than the reflection area in the prior art. Disturbing effects due to outside light, reflections, etc. are accordingly substantially done away with. The light guide can consist of a monoblock, for instance of plexiglass or glass, or else it may be of multipart construction.

One feature which is favorable in this respect is the use of suitable light-guide fibers in a holder piece. The holder piece can be developed in such a manner that it can be installed in a structurally favorable manner into the storage member. The use of such a holder piece is favorable in particular in the case of stationary storage members with which a rotating thread eye is associated.

Another advantageous feature resides in forming the holder piece as a bow-shaped piece. The bow-shaped piece is so shaped that the end surfaces of the light-guide fibers are arranged adjacent each other. This has the advantage that both transmitter and receiver of the light monitor can be contained in a common housing, resulting in a simplified construction.

It is furthermore advantageous for the ends of the light-guide fibers to lie in two adjacent bars displaceably associated with the storage member for the variation of the outer surface of the storage member in the region of the thread-winding-on point. The bars thereby satisfy a twofold function. On the one hand, they serve to vary the winding conditions. On the other hand, they are also holders of the light-guide fibers. They provide a sufficiently large fastening surface for the ends of the light-guide fibers. Furthermore, upon the displacement of the bars the end surfaces of the light-guide fibers move along therewith.

If the storage member is rotatable then several bow-shaped pieces are provided one after the other in the circumferential direction of the storage member in such a manner that their distance from each other is smaller than the cone aperture of the light monitor transmitter and receiver. This means that after the storage member has stopped in any angular position the light emitted by the transmitter is always conducted to the receiver over a bow-shaped piece.

Finally, it is also advantageous from a manufacturing standpoint for the holder piece to consist of two plates which are concentric to each other and receive the light-guide fibers between them. Aluminum is preferably employed for the plates. The light-guide fibers lie protected between these plates, which contributes to an increase in stability.

BRIEF DESCRIPTION OF THE DRAWINGS

One embodiment of the invention will be described below with reference to FIGS. 1 to 4 of the drawing, in which.

DETAILED DESCRIPTION OF THE PREFERRED EMBODIMENT

Figure 1:
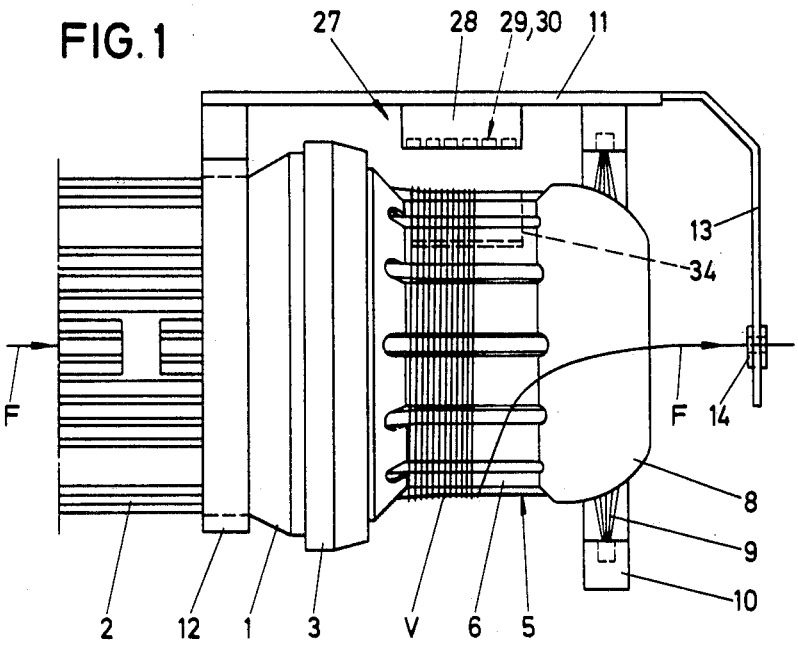
FIG. 1 is a view of a suitably developed delivery device equipped with a light monitor.
Figure 2:
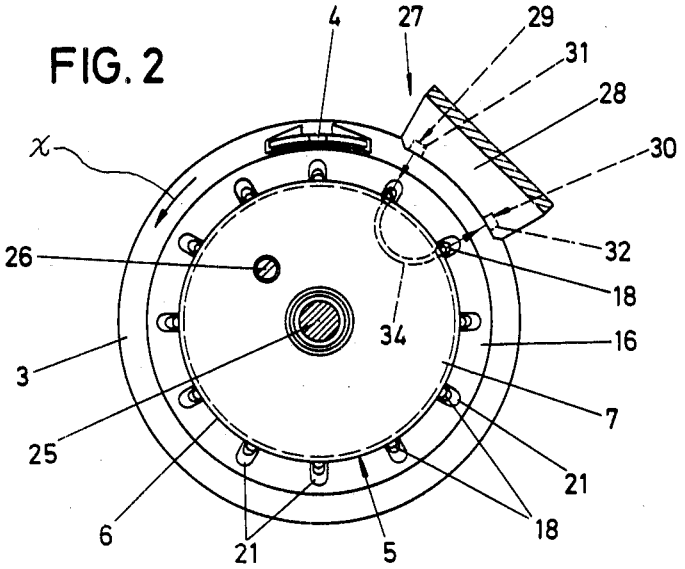
FIG. 2 is an end view of the delivery device, the barrel-shaped annular head surface of the storage member being omitted.

The delivery device has an electric motor 2 which is flanged onto a housing 1 and forms the rotary drive. Some other indirect drive could also be used. Its motor shaft, not shown in detail, is connected, fixed for rotation, to a thread-eye holder 3. The incoming thread F passes into a central channel in the motor shaft and from there to the thread eye 4 of the thread-eye holder 3 which rotates in the direction of the arrow x shown in FIG. 2. A brake device, not shown in detail but known in connection with such delivery devices, is associated with the rotary drive.

The motor shaft of the electric motor 2 bears a storage member 5. The storage member is a stationary storage member. It has, in detail, an outer wall 6 developed as a drum which passes at the removal end of the delivery device into an end wall 7. A barrel-shaped annual head surface 8 extends over the withdrawal-side end of the outer wall 6. With the head surface 8 there is associated a brake ring 10 provided with bristles 9, which in its turn is seated on a bracket 11. The latter is fastened to the housing 1 by means of an annular flange 12.

The end of the bracket 11 which faces the annular head surface 8 bears on a bent-off portion 13 a thread withdrawal eye 14 which is coaxial to the axis of the storage member 5 and is arranged spaced in front of the annular head surface 8.

The end of the outer wall 6 facing the thread-eye holder 3 passes via an annular angle channel 15 into a conical widening 16. The angle of inclination of this conical widening is about 45°. Adjoining the conical widening 16 there is a parallel extending section 17 which is gripped overlapped by the thread-eye holder 3.

Bars 18 arranged at an equal angular distance apart are associated with the storage member 5, these bars lying partially within grooves 19 in the outer wall 6 and protruding beyond it. The bars 18 which extend approximately over the entire axial length of the storage member 5 form on their part, at their ends facing the angle channel 15, angle channels 20 of their own. Their channel angle is somewhat less than 180°. The ends 22 of the bars 18 which adjoin the angle channels 20 engage in slots 21 in the conical widening 16 which extend from the grooves 19. The bars rest via these ends 22 against radially directed fingers 23 of a displacement disk 24.

Figure 3:
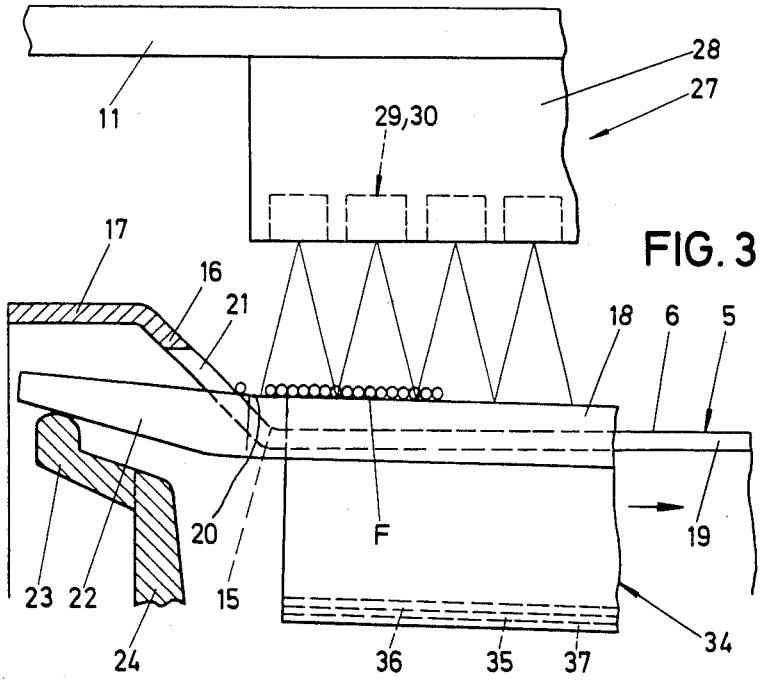
FIG. 3 shows, on a larger scale, a longitudinal section through a portion of the storage member in the region of the point of feed of the thread and of the light monitor.
Figure 4:
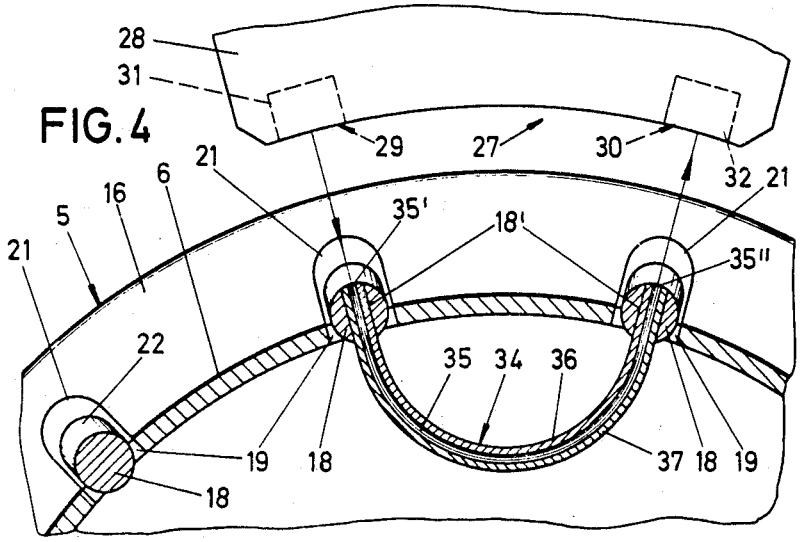
FIG. 4 is a cross section through the storage member shown in FIG. 3.

By means of a central handle 25 which is accessible from the annular head surface 8 the bars 18 together with disk 24 and fingers 23 can be displaced simultaneously in the direction of the arrow shown in FIG. 3. However, it is also possible to move solely the displacement disk 24 via the setting screw 26. The latter is also accessible from the annular head surface 8. Displacement of the disk 24 in the direction indicated by the arrow leads to a swinging of the bars 18 around a pivot point located close to the annular head surface. In both cases the winding conditions are changed in the region of the place of feed of the thread.

On the bracket 11 there is furthermore provided a light monitor 27 which extends over the entire storage length of the storage member 5. The storage length in the embodiment shown is less than the length of the storage member 5.

The light monitor 27 has a housing 28. This housing bears a transmitter 29 and receiver 30 of the light monitor. Both transmitter 29 and receiver 30 have their axes parallel to the axis of the storage member 5. The transmitter 29 of the light monitor has light-emitting diodes 31 of adjustable luminous intensity which emit modulated light and are arranged in a row alongside of each other. Each light-emitting diode 31 has associated with it its own sensor 32 in the light monitor receiver 30.

Opposite the light monitor 27 a holder piece 34 is provided on the storage member 5. The holder piece is developed as a bow-shaped piece and consists of two plates 36 and 37 which are concentric to each other and receive light guide fibers 35 between them. As material for the plates 36, 37 aluminum, for instance, can be used. The light-guide fibers 35 are so arranged that their end surfaces 35', 35'' lying in rows alongside of each other are exposed towards the outer surface of the storage member. In each case one end surface 35' of each light-guide fiber 35 faces the light monitor transmitter 29 and the other end surface 35'' faces, offset in the circumferential direction of the storage member 5, the light monitor receiver 30. The end sections of the bow-shaped piece are in this connection contained in slots 18' of two adjacent bars 18 in such a manner that the end surfaces 35', 35'' are flush with the outer surface of the bars 18. Accordingly, upon displacement of the bars the end surfaces 35', 35'' of the light-guide fibers 35 are also shifted.

If the thread F is placed on the storage member 5 and the delivery device connected, then the luminous intensity first measured by the light monitor receiver 30 is relatively large so that the rotary drive operates at increased speed of rotation. With increasing amount V of thread stored, the intensity of the light measured by the light monitor receiver 30 decreases hand in hand with a reduction in the speed of rotation of the rotary drive. As a result of the continuous removal of thread, the intensity of the light, however, again increases with again an increase in speed of rotation of the thread-eye holder 3. Therefore the rotary drive does not need to be completely stopped. Peak stresses which lead to breakage of the thread are in this way avoided.

If the intensity of the light of the transmitter 29 is increased, the light response threshold shifts hand in hand with this. In this way there takes place an increase in the speed of rotation together with an increase in the supply of thread on the storage member.

Figure 5:
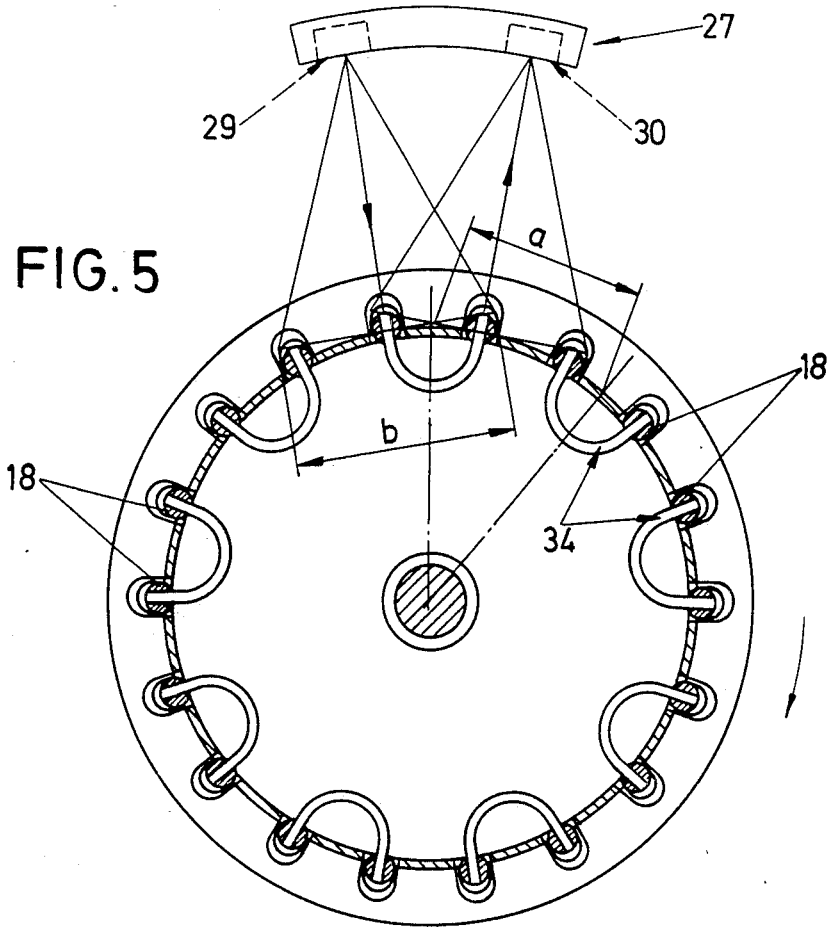
FIG. 5 is a cross-section through a rotatable storage member of another embodiment of the invention.
Figure 6:
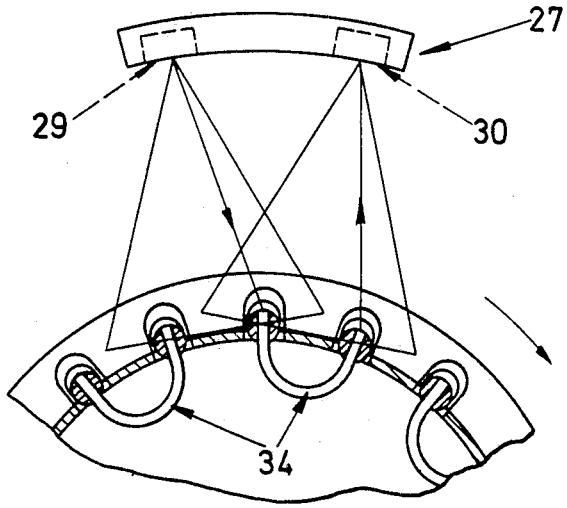
FIG. 6 is a portion of FIG. 5 in a slightly different rotated position.

In case of the use of a rotating storage member a plurality of such bow-shaped pieces would then be arranged one after the other in the circumferential direction of the storage member (FIGS. 5 and 6). The distance apart must then be maintained smaller than the aperture cone corresponding to the light monitor transmitter and receiver. Thus in every position of rotation of the storage member the light monitor is in position ready to operate.

FIG. 5 shows bow-shaped holder pieces 34 having uniform spacing a of adjacent pieces in circumferential direction of the storage member 5. The storage member 5 rotates in the direction as indicated by the curved arrow. The spacing a is smaller than the aperture cone b of light with respect to the transmitter 29 and receiver 27. Light from the transmitter 29 in FIG. 5 entering one end of a holder piece 34 leaves the other end directed into the receiver 27 as shown in FIG. 5 by the arrows in the light ray paths directly between the ends of the holder piece 34 and the receiver and transmitter. FIG. 6 shows the storage member slightly rotated relative to the position of FIG. 5, whereby the direct light (also provided with arrows in FIG. 6) to and from the ends of the bow-shaped holder piece 34 also passes therethrough and is received by the receiver 27. In every position of the storage member 5 the light monitor is operable.

A light monitor which does not extend over the entire storage length can also be used. The light monitor is then to be mounted displaceable with respect to the storage member. In such case the delivery device operates in accordance with the start-stop principle.

I claim:

1. In a delivery device for continuous threads, having a storage member to which a thread passes in circumferential direction and from which the thread is withdrawn, on which member a predetermined adjustable number of turns of thread is stored as a storage quantity between a place of feed of the thread and a place of withdrawal of the thread, a rotary drive for delivering the thread to the storage member, a light monitor which scans the outer surface of the storage member for determining the turns of thread and for controlling the rotary drive for the delivering of the thread, the improvement wherein the light monitor comprises a transmitter and a cooperating receiver, the storage member has a light guide having end surfaces exposed towards an outer surface of the storage member, one of said end surfaces of each light guide faces the transmitter and the other of said end surfaces faces the receiver, and said other end surface is staggered in circumferential direction of the storage member relative to said one end surface.

2. The delivery device according to claim 1, wherein the light guide comprises light-guide fibers lying in a row alongside of each other, and a holder piece holding said light-guide fibers.

3. The delivery device according to claim 2, wherein the holder piece is formed as a bow-shaped piece.

4. A delivery device according to claim 2, further comprising bars forming the outer surface of the storage member, said bars are displaceably mounted on said storage member for variation of the outer surface of the storage member in the region of a thread-wind-on point, said end surfaces of the light guide fibers lie in two adjacent of said bars.

5. The delivery device according to claim 3 wherein a plurality of said bow-shaped pieces are provided one after the other in a circumferential direction of the storage member in such a manner that their respective distance from each other is smaller than an aperture cone of said transmitter and receiver.

6. The delivery device according to claim 2 wherein the holder piece comprises two plates which are concentric to each other, and the light-guide fibers are mounted between said plates.

* * * * *